US005269164A

United States Patent [19]

Choi

[11] Patent Number: 5,269,164

[45] Date of Patent: Dec. 14, 1993

[54] DEVICE FOR FORMING SPIRAL GROOVE ON INNER WALL OF CYLINDRICAL CAVITY

[75] Inventor: Jin-seung Choi, Kyungki-do, Rep. of Korea

[73] Assignee: SamSung Electronics Co., Ltd., Kyungki-do, Rep. of Korea

[21] Appl. No.: 930,328

[22] Filed: Aug. 17, 1992

[30] Foreign Application Priority Data

Oct. 29, 1991 [KR] Rep. of Korea ..... 91-18149

[51] Int. Cl.[5] ..... B21D 17/04

[52] U.S. Cl. ..... 72/75

[58] Field of Search ..... 72/75

[56] References Cited

U.S. PATENT DOCUMENTS 1,273,475 7/1918 Foster ..... 72/75

2,657,733 11/1953 Champion ..... 72/75

4,196,608 4/1980 Amado, Jr. ..... 72/75

FOREIGN PATENT DOCUMENTS 260456 12/1969 U.S.S.R. ..... 72/75

*Primary Examiner*—Lowell A. Larson

*Attorney, Agent, or Firm*—Robert E. Bushnell

[57] ABSTRACT

A device for forming a spiral groove on the inner walls of a cylindrical cavity including a rod having a cylindrical recess and pair of through holes, machining balls in the through holes, a tapered support located in the cylindrical recess, whose tapered sides support the machining balls, a spring located between the support and the other end of the cylindrical recess for supporting the support, and a push cap coupled to the aperture of the recess for deciding the location of the support by pressing the support supported by the spring. The device can freely adjust the height of the machining balls protruding from in the through holes according to the inner diameter of a bearing's cylindrical cavity, thereby easily forming spiral grooves of uniform depth.

5 Claims, 2 Drawing Sheets

DEVICE FOR FORMING SPIRAL GROOVE ON INNER WALL OF CYLINDRICAL CAVITY

BACKGROUND OF THE INVENTION

The present invention relates to a device for forming a spiral groove on the inner wall of a cylindrical cavity, and more particularly to a device for forming a lubricating-oil-guiding spiral groove on the inner wall of a bearing's cavity which abrades the outer surface of a shaft.

Usually, lubricating oil is coated on the inner wall of a cylindrical cavity of a radial bearing through which a cylindrical shaft passes so as to reduce friction due to the sliding of the shaft against the inner wall of the cavity. The lubricating oil forms a thin oil film between the outer surface of the shaft and the inner wall of the cavity to prevent friction between them and to prevent the abrasion of portions thereof.

When using lubricating oil, the state of the oil film formation is very important to effectively protects parts which undergo friction. If parts of an oil film do not form, friction increases in those portions, to cause severe abrasion, thus causing the support between the oiled items, e.g., a shaft and bearing, to become unstable. To prevent this, a lubricating oil guiding groove for stably supplying the lubricating oil is formed on the inner wall of the bearing's cavity. The amount of lubricating oil supplied and the state of oil film formation vary according to the depth of the guiding groove. The deeper the groove is, the more lubricating oil should be supplied. However, if the groove is too deep, lubricating oil is wasted because it is supplied excessively, and a stable and uniform oil film cannot be formed. If the groove is too shallow, the lubricating oil is not wasted but the supply thereof is not stable enough to form a consistent oil film. Therefore, the groove should be formed by a precise machining device.

FIG. 1 is a conventional device for forming a lubricating-oil-guiding spiral groove on the inner wall of a radial bearing's cavity.

The groove-forming device has a rod 1 whose machining portion 1*c* placed at the front end thereof is put into a cylindrical cavity of a bearing 5. A cylindrical portion 1*a* of a predetermined diameter is formed at the end face of machining portion 1*c*. Cylindrical portion 1*a* is plugged with a threaded cap 4. The plugged cylindrical portion 1*a* communicates with the exterior via two through holes 1*b*. As machining tips, machining balls 2 are provided in through holes 1*b*. A rod-shaped support 3 for supporting machining balls 2 is provided in cylindrical portion 1*a*. Machining balls 2 protrude a predetermined height from the external surface of machining portion 1*c* due to support 3 so as to make pressed contact with the inner surface of the cavity of bearing 5 which is an object to be machined. Machining balls 2 have a hardness higher than that of the object to be machined, i.e., bearing 5.

In order to form a guiding groove on the inner surface of the cavity of bearing 5, the rod is rotated at a predetermined speed and the machining portion at the end thereof is put into the bearing's cavity also at a predetermined speed. The machining balls of the machining portion are spirally moved to form the spiral shape in the inner surface of the cavity. By doing this, the guiding groove is formed.

However, with the conventional device for forming a lubricating-oil-guiding groove in a bearing, bearings only of certain diameters can be machined since the protruding height of the machining balls is fixed. Thus, undesirably, bearings of widely varying diameters cannot be machined, using one device, which makes guiding-groove-forming devices of various sizes necessary.

SUMMARY OF THE INVENTION

Therefore, it is an object of the present invention to provide a device for forming a spiral groove on the inner wall of a cylindrical cavity which is capable of machining bearings of different diameters.

It is another object of the present invention to provide a device for forming a spiral groove on the inner walls of a cylindrical cavity which is capable of controlling the groove's depth.

To accomplish the above objects, there is provided a device for forming a spiral groove on the inner walls of a cylindrical cavity comprising: a rod being rotated at a predetermined speed, moved along its axis, and having a cylindrical recess in the end thereof and a pair of through holes spaced by a predetermined distance and formed near the end of the rod and communicating with the cylindrical cavity; machining balls of a predetermined hardness located in the through holes; a tapered support of a predetermined length, located in the cylindrical recess, whose tapered sides support the machining balls; a spring located between the support and the other end of the cylindrical recess for supporting the support; and a push cap coupled to the aperture of the recess for deciding the location of the support by pressing the support supported by the spring.

In the device for forming a spiral groove on the inner walls of a cylindrical cavity of the present invention, a spiral spring is employed for the spring. It is desirable that the push cap for deciding the location of the support be screw-coupled with the recess so as to move back and forth in the moving direction of the support.

BRIEF DESCRIPTION OF THE DRAWINGS

The above objects and other advantages of the present invention will become more apparent by describing in detail a preferred embodiment thereof with reference to the attached drawings in which.

DETAILED DESCRIPTION OF THE INVENTION

Figure 1:
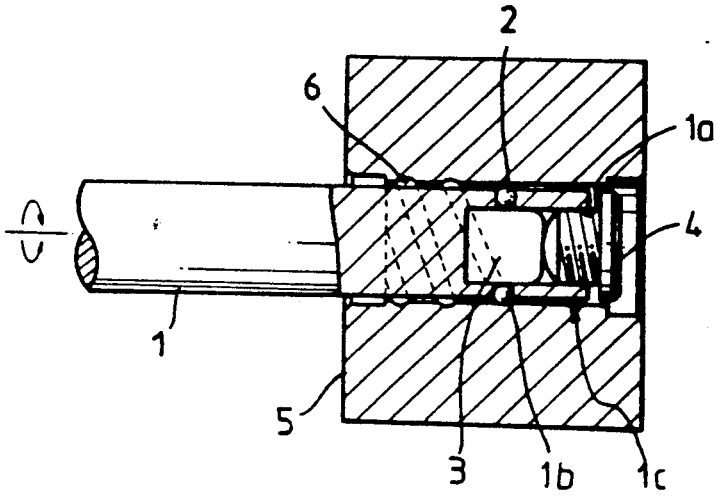
FIG.1 (PRIOR ART)
FIG. 1 is a cross-sectional view of a conventional device for forming a spiral groove on the inner wall of a cylindrical cavity.
Figure 2:
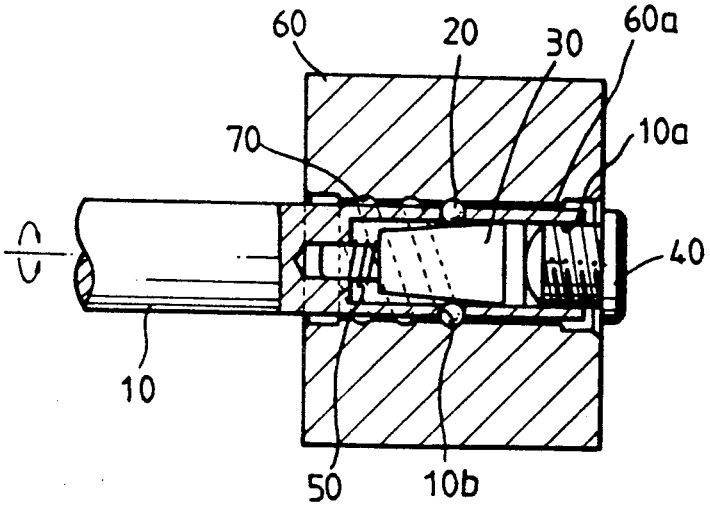
FIG. 2 is a cross-sectional view of a device for forming a spiral groove on the inner wall of a cylindrical cavity according to the present invention.
Figure 3:
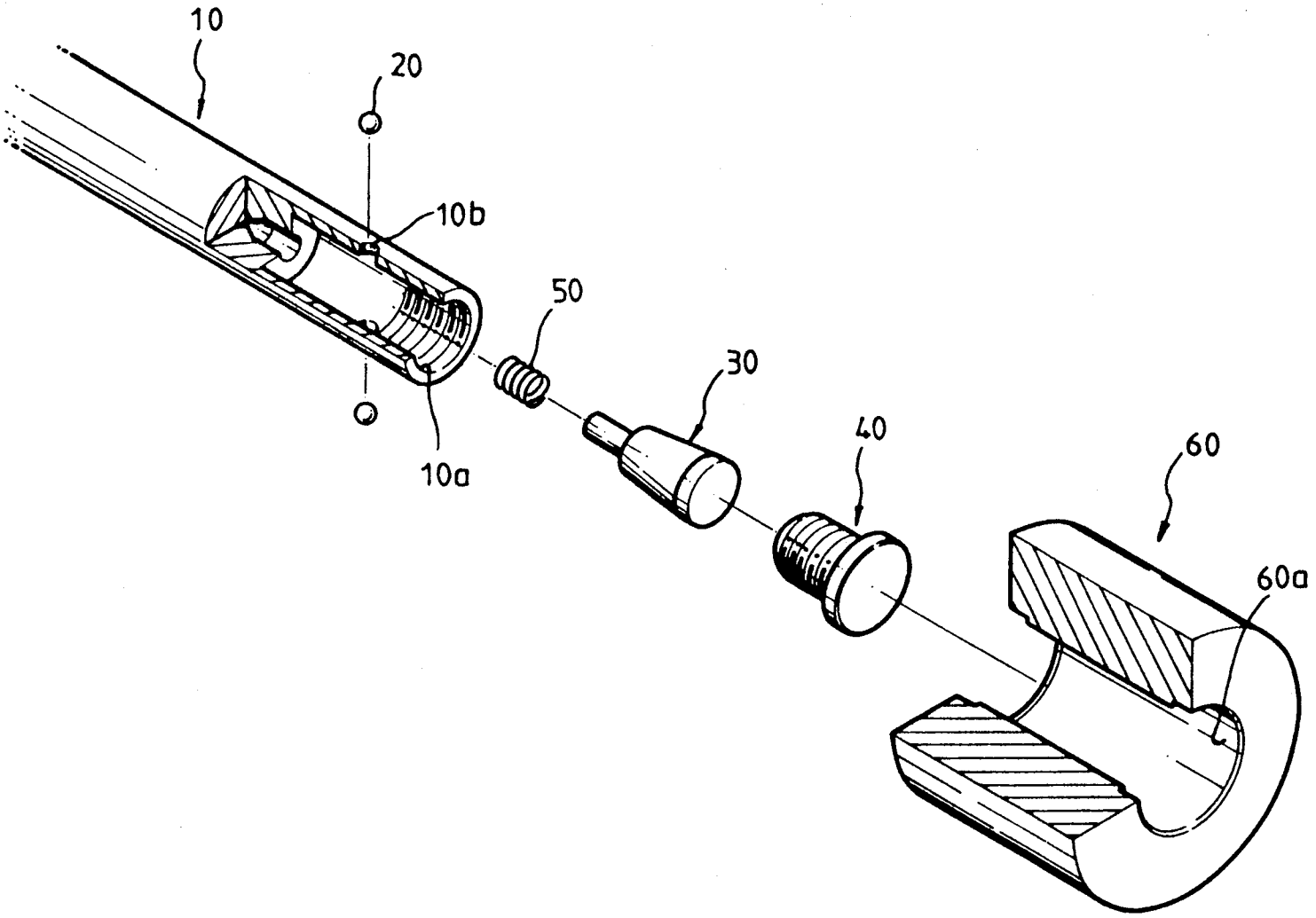
FIG. 3 is a exploded perspective view of the device shown in FIG. 2.

Referring to FIGS. 2 and 3, a cylindrical recess 10*a* having a predetermined depth is provided in the end of a rod 10, and inserted into a cylindrical cavity 60*a* of a bearing 60. A pair of through holes 10*b* communicating with cylindrical recess 10*a* are formed on the opposing outer surfaces of rod 10.

Machining balls 20 for substantially forming a spiral groove 70 on the inner surface of bearing 60 are provided in through holes 10*b* of rod 10 to protrude a certain height from the through holes. Here, machining balls 20 have a hardness higher than that of an object to be machined, i.e., bearing 60.

A tapered support 30, having support faces tapered at a predetermined angle to the inner side of cylindrical recess 10*a* and supporting machining balls 20 protruding from through holes 10*b*, is provided in rod 10.

A support-location-deciding push cap 40 for defining the position of tapered support 30 inserted into cylindrical recess 10*a*, is spirally coupled to one end of cylindrical recess 10*a* of rod 10.

Spring means for elastically biasing tapered support 30 toward the external of cylindrical recess 10*a*, e.g., a spiral spring 50, is interposed between the other end of cylindrical recess 10*a* and tapered support 30.

In order to form the spiral groove on the inner walls of the bearing using the groove-forming device of the present invention, as shown in FIG. 2, rod 10 is inserted into cylindrical cavity 60*a* of bearing 60. Here, machining balls 20 protruding from through holes 10*b* of rod 10 protrude beyond the inner diameter of cylindrical cavity 60*a* of bearing 60. Rod 10 is rotated clockwise to form spiral groove 70 on the inner face of cylindrical cavity 60*a* of bearing 60. When machining balls 20 reach the inner center of cylindrical cavity 60*a* of bearing 60, rod 10 is rotated counterclockwise to form spiral groove 70 whose direction opposes that of the groove previously formed on the inner face of cylindrical cavity 60*a* of bearing.

Meanwhile, forming a spiral groove on the inner face of a cylindrical cavity of bearings of different diameters can be carried out by spirally controlling support-location-deciding push cap 40 for supporting tapered support 30. More specifically, when support-location-deciding push cap 40 is spirally controlled, tapered support 30 is laterally moved by the elasticity of spiral spring 50, and concurrently, machining balls 20 supported by the tapered supporting faces of tapered support 30 are vertically moved in through holes 10*b* of rod 10 in the perpendicular direction of tapered support 30. This allows adjustment of the protruding height of machining balls 20 to a height appropriate for the inner diameter of cylindrical cavity 60*a* of bearing 60. In other words, regardless of the inner diameter of cylindrical cavity 60*a* of bearing 60, spiral groove 70 can be formed with ease.

As described above in detail, the device for forming a spiral groove on the inner wall of a cylindrical cavity according to the present invention, is capable of freely adjusting the height of a machining ball protrudently installed in a through hole of a rod according to the inner diameter of the bearing's cylindrical cavity, thereby easily forming spiral grooves of uniform depth. Therefore, the bearing having a spiral groove formed by the present invention functions as a smooth-sliding bearing due to lubricating oil injected into the groove, when a rod is inserted into the cavity and rotated therein.

While the present invention has been particularly shown and described with reference to particular embodiments thereof, it will be understood by those skilled in the art that various changes in form and details may be effected therein without departing from the spirit and scope of the invention as defined by the appended claims.

What is claimed is:

1. A device for forming a spiral groove on inner walls of a cylindrical cavity comprising:

a rod being rotated at a predetermined speed, moved along its axis, and having a cylindrical recess in an end of said rod and a pair of opposite through holes formed near the end of said rod and communicating with said cylindrical recess;

machining balls of a predetermined hardness located in said through holes;

a tapered support of a predetermined length, located in said cylindrical cavity, whose tapered sides support said machining balls;

spring means located between said tapered support and an end of said cylindrical recess away from the end of said rod, for supporting said tapered support so as to elastically bias said support toward an aperture of said cylindrical recess; and a push cap coupled to the aperture of said cylindrical recess for adjusting a location of said support by pressing said tapered support supported by said spring means.

2. An apparatus for forming a spiral groove on inner walls of a bearing having a cylindrical cavity, comprising:

a rod having a cylindrical recess at one end of said rod and a pair of opposite through holes formed from said cylindrical recess to a periphery of said rod;

a pair of machining balls for forming the spiral groove on the inner walls of the bearing, each of said pair of machining balls located in each one of said pair of opposite through holes, respectively;

a cylindrical tapered support disposed to move axially in said cylindrical recess of said rod and contacting said pair of machining balls, for moving said pair of machining balls radially with respect to said rod in dependence upon said axial movement of said cylindrical tapered support;

spring means located between a wall of said cylindrical recess and said cylindrical tapered support, for biasing said cylindrical tapered support toward an aperture of said cylindrical recess opposite said wall of said cylindrical recess; and a push cap coupled to said aperture of said cylindrical recess, for pressing cylindrical tapered support toward said wall of said cylindrical recess.

3. The apparatus as claimed in claim 2, further comprising:

a slot formed in said wall of said cylindrical recess; and a protrusion formed on an end of said cylindrical tapered support, said protrusion sliding axially in said slot, for maintaining axial movement of said cylindrical tapered support.

4. The apparatus as claimed in claim 3, wherein said cylindrical tapered support has a smallest radius at said end formed with said protrusion.

5. The apparatus as claimed in claim 2, further comprising:

a protrusion formed on an end of said cylindrical tapered support, for maintaining axial movement of said cylindrical tapered support; and said cylindrical tapered support having a smallest radius at said end formed with said protrusion.

* * * * *